US005832802A

United States Patent [19]

Warthen et al.

[11] Patent Number: 5,832,802

[45] Date of Patent: Nov. 10, 1998

[54] APPARATUS FOR CUTTING PILED FABRIC

[75] Inventors: William Perry Warthen, Spartanburg; John Bonner Manly, Jr., Moore, both of S.C.

[73] Assignee: Milliken Research Corporation, Spartanburg, S.C.

[21] Appl. No.: 587,429

[22] Filed: Sep. 8, 1995

Related U.S. Application Data

[63] Continuation of Ser. No. 110,055, Aug. 30, 1993, abandoned.

[51] Int. Cl.[6] ..... D06H 7/00; B26D 1/06; B26D 7/26

[52] U.S. Cl. ..... 83/555; 83/452; 83/556; 83/558; 83/563; 83/564; 83/620; 83/694

[58] Field of Search ..... 83/554, 555, 556, 83/564, 618, 620, 699.31, 699.41, 55, 558, 563, 452, 639.1, 639.5, 694, 640

[56] References Cited

U.S. PATENT DOCUMENTS

| | | | |
|---|---|---|---|
| 484,369 | 10/1892 | Horner | 83/620 X |
| 629,532 | 7/1899 | Thomas | 83/620 X |
| 2,690,219 | 9/1954 | Feiertag | 83/556 |
| 2,833,349 | 5/1958 | Green | 83/699.31 X |
| 3,440,914 | 4/1969 | Klein | 83/556 |
| 3,726,170 | 4/1973 | Von Hofen | 83/556 |
| 3,788,181 | 1/1974 | Adair | 83/554 |
| 3,828,639 | 8/1974 | Roch | 83/620 |
| 4,061,065 | 12/1977 | Arriola | 83/562 |
| 4,175,686 | 11/1979 | Lang | 83/696 X |
| 4,250,786 | 2/1981 | Bleich | 83/699.41 X |
| 4,742,747 | 5/1988 | Kirsch | 83/699.41 X |
| 5,134,916 | 8/1992 | Klopfer | 83/699.41 X |
| 5,195,412 | 3/1993 | Flemming et al. | 83/37 |

FOREIGN PATENT DOCUMENTS

| | | | |
|---|---|---|---|
| 246029 | 5/1911 | Germany | 83/620 |

*Primary Examiner*—Clark F. Dexter
*Attorney, Agent, or Firm*—Terry T. Moyer; George M. Fisher

[57] ABSTRACT

An apparatus and method for cutting piled fabric sections such as carpet tiles is provided. The apparatus comprises a frame, a bending assembly for bending pile elements away from the normal substantially vertical orientation with respect to the base of the fabric along a line to be cut, at least one cutting blade for cutting the fabric through a portion of the bent piling elements and fabric base and power assemblies for powering the bending and cutting operations. The related method comprises the steps of bending the pile elements downward toward the fabric base along a line to be cut and thereafter cutting through the bent piling elements and fabric base to form a two-sided cut. Such method shears piling elements adjacent to one side of the cut while leaving the pile elements adjacent to the other side of the cut substantially unaltered.

2 Claims, 9 Drawing Sheets

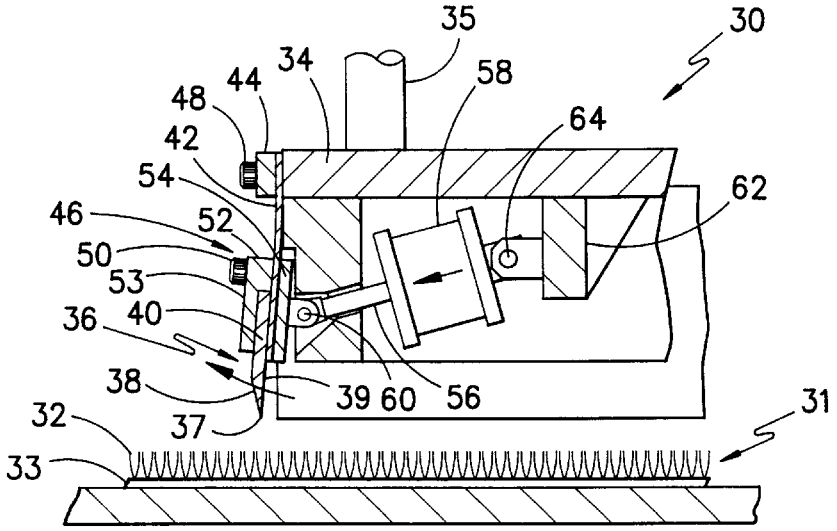
FIG. —1—
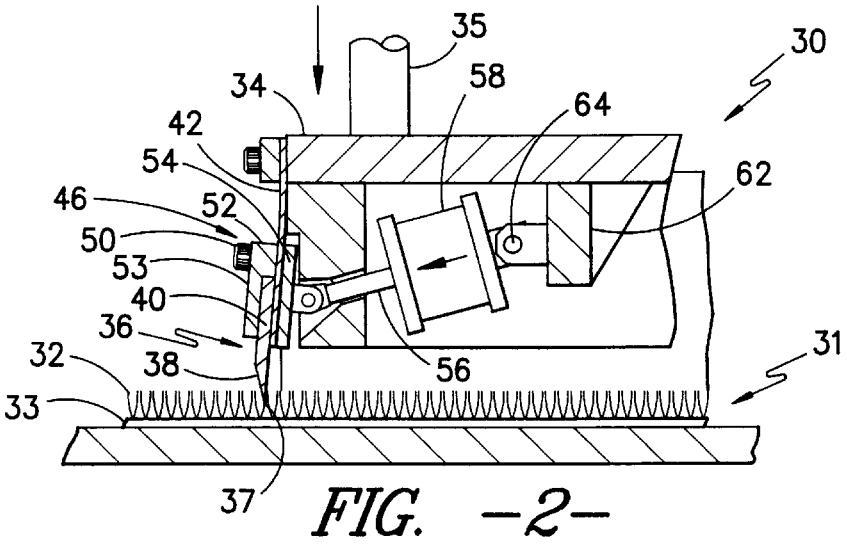
FIG. —2—
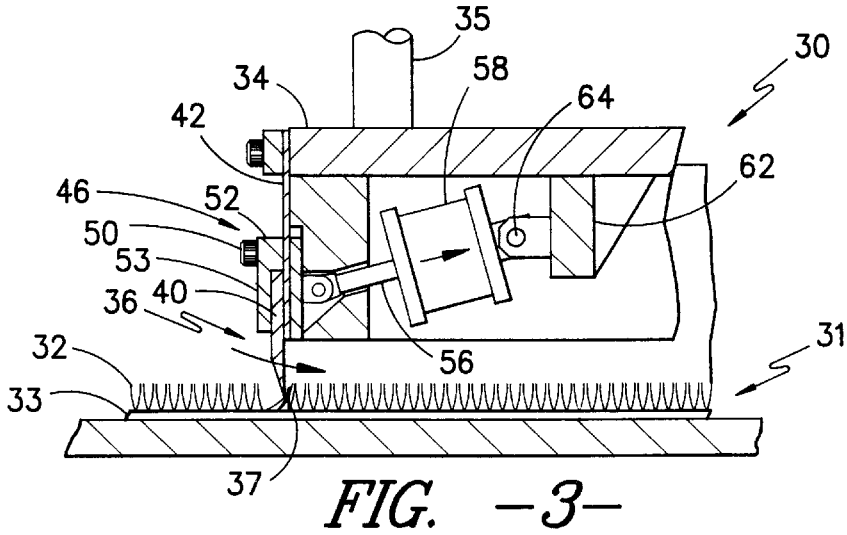
FIG. —3—

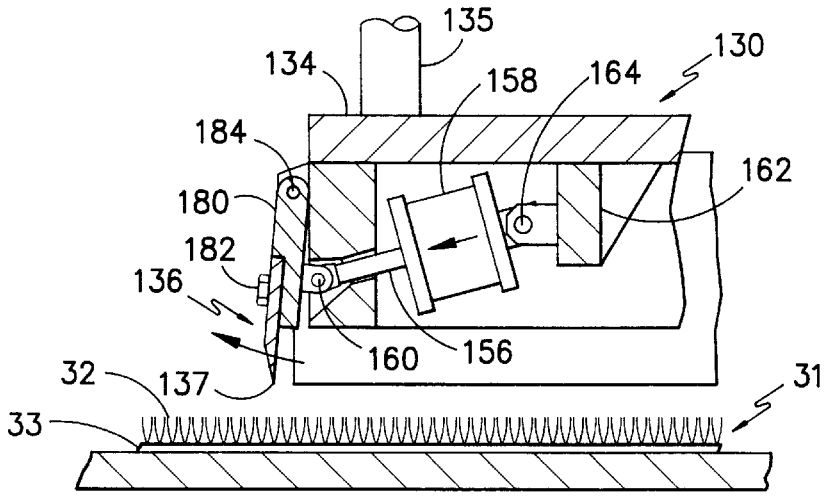
FIG. –6–
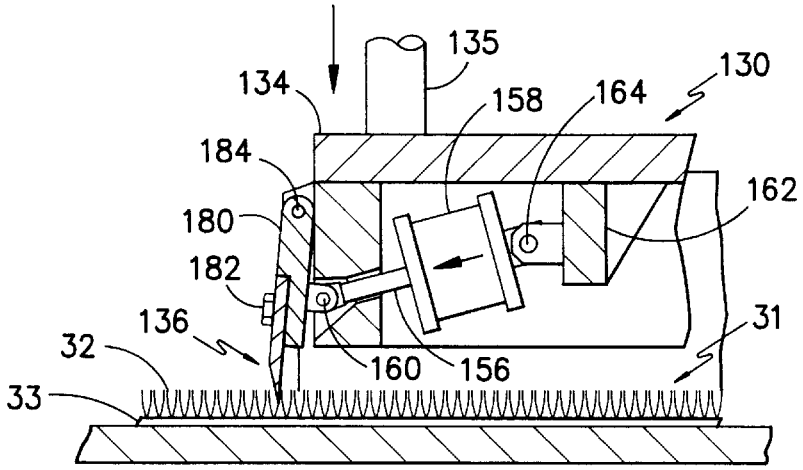
FIG. –7–
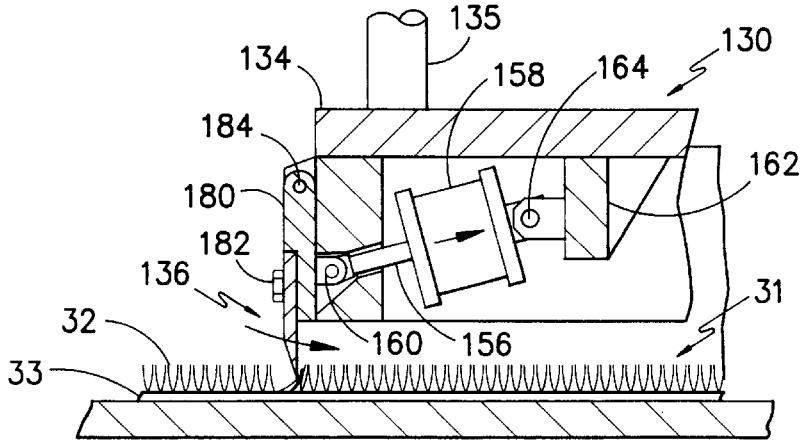
FIG. –8–

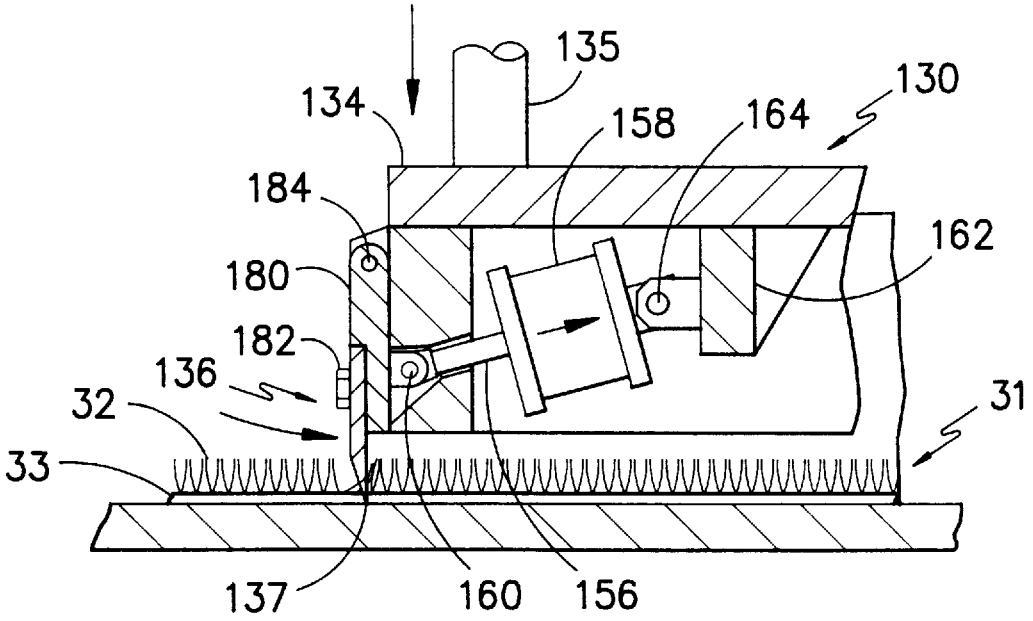
FIG. —9—
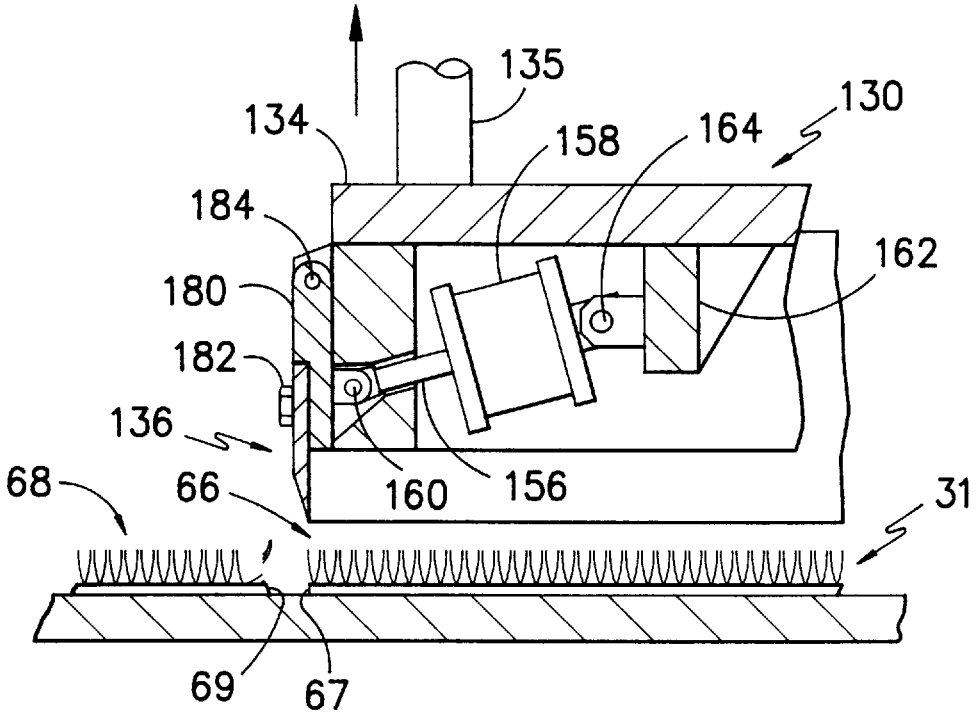
FIG. —10—

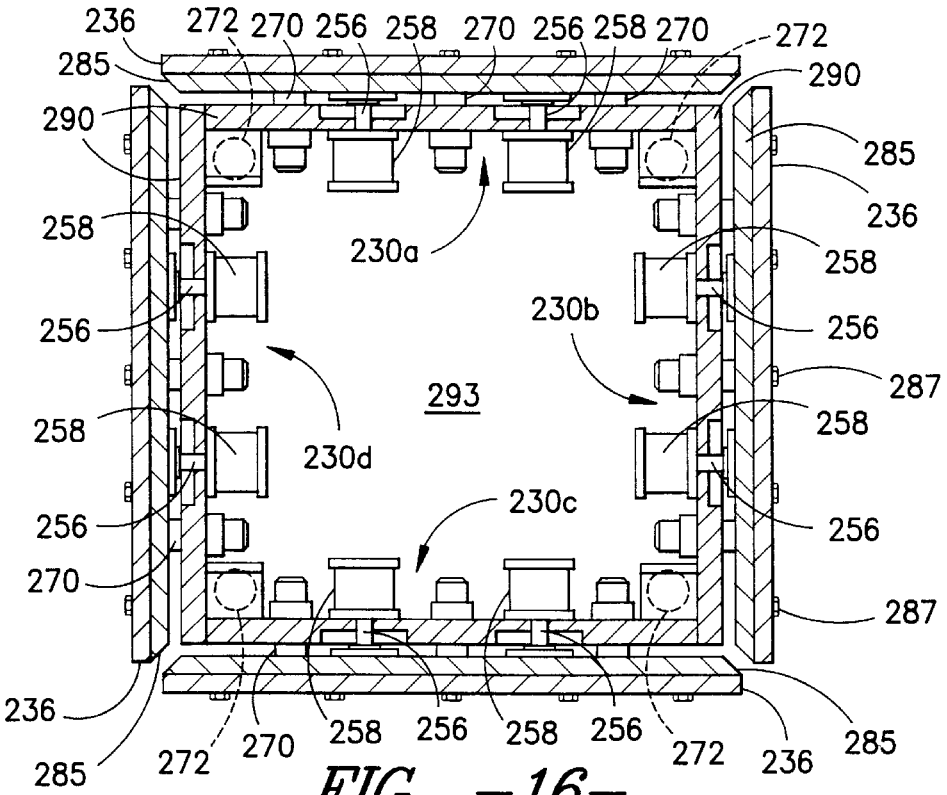
FIG. –16–
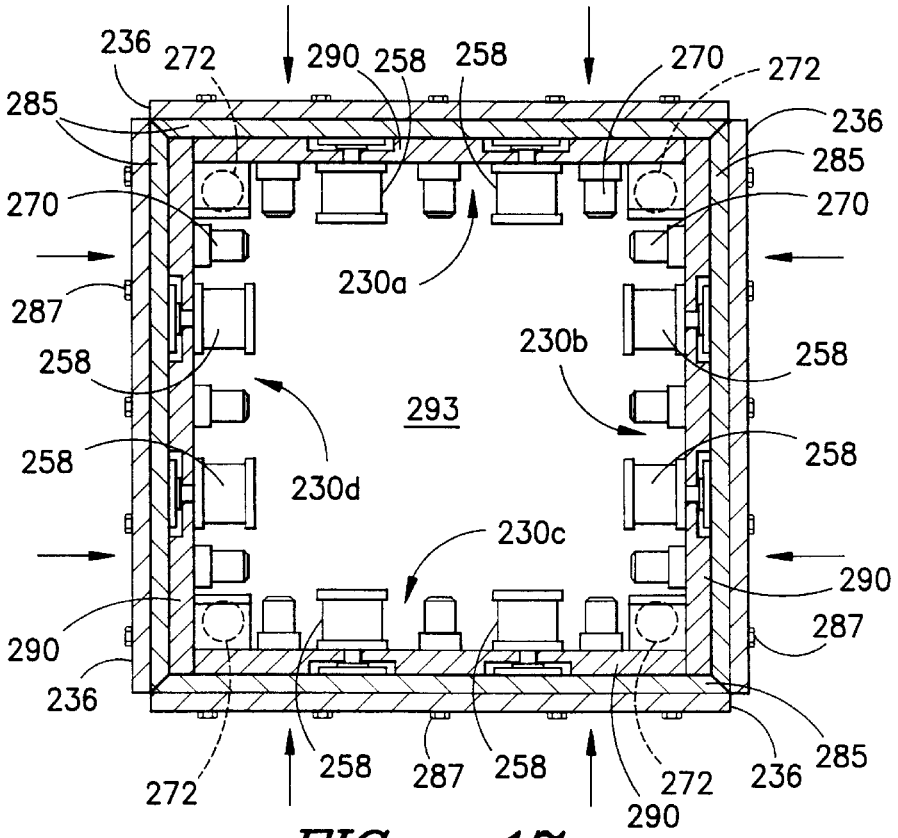
FIG. –17–

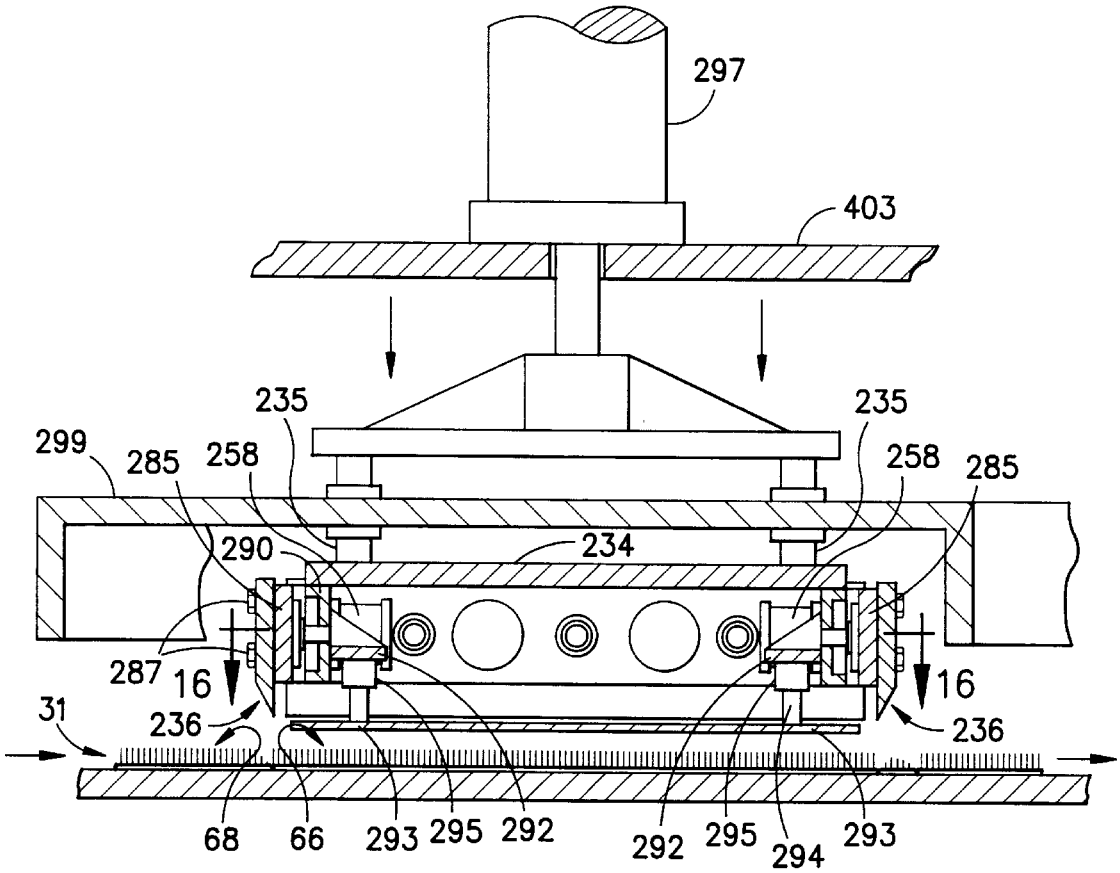
FIG. –18–

APPARATUS FOR CUTTING PILED FABRIC

RELATED APPLICATIONS

This application is a continuation of prior application Ser. No. 08/110,055, filed on Aug. 30, 1993, now abandoned.

FIELD OF THE INVENTION

The present invention relates generally to fabrics and more particularly to piled fabric sections such as carpet tiles and to an apparatus and method for cutting the same such that the juncture between fabric sections is substantially unidentifiable when they are placed in abutting relation to one another across a surface to be covered.

BACKGROUND

Piled fabrics, such as for example carpets, may be manufactured in numerous ways such as by weaving, tufting, needling or bonding. In each method the pile is secured in some manner to a base layer thereby forming a composite structure comprising a piling portion and a base portion. The base is generally substantially solid yet flexible in nature and typically comprises a bonding matrix in combination with a backing material. Some typical configurations of piled fabrics are illustrated in FIGS. 5–11 of U.S. Pat. No. 4,576,665 to Machell the teachings of which are incorporated herein by reference. Carpet configurations are also illustrated in U.S. Pat. No. 4,522,857 to Higgins (incorporated by reference).

Regardless of the specifics of the piled fabric configuration, the fabric will comprise generally a piling portion having a multiplicity of pile elements and some type of stable base portion to which the pile elements are attached in an outwardly extending generally perpendicular fashion. Accordingly, the surface of the base adjacent to the outwardly extending pile elements forms a boundary between the piling and base portions. Above this boundary the pile elements may be bent rather freely.

As will be readily recognized, any bending of a pile element away from a perpendicular orientation with respect to the boundary surface of the base will tend to bring the pile element towards the base portion of the fabric. Moreover, due to the generally close packed nature of the pile elements, the bending of one element will lead to the bending of adjacent elements in the direction of the applied force.

So as to facilitate ease of handling during transportation and installation, piled fabrics such as carpet are often formed into easily handled modular sections referred to generally as carpet tiles. These tiles are typically cut into discrete elements from a broad loom of piled fabric having the characteristics described above. The tiles are typically of a rectangular shape and are preferably substantially square so as to permit them to be laid side by side in abutting relation across a surface to be covered.

It has long been recognized that a problem often arises in forming the edge portions of carpet tiles which are to be abutted together. A straight cut by means of a rotary blade or similar device may tend to leave half cut tufts and/or missing tufts along the edge of the tile. These half cut and missing tufts may give rise to a substantial degree of asymmetry from tile to tile. Furthermore, a straight cut leaving such half cut and missing tufts may give rise to voids at the juncture between the tiles installed across a surface to be covered. In the past, these problems have been addressed by cutting the edges of the tile on a chamfer, thereby generating a substantially uniform beveled appearance at the edges of the individual tiles. Due to the bevelled edges formed on the individual tiles, the height of the piling immediately adjacent to the edge of each tile is typically less than that existing across the rest of the tile. Moreover, this feature is replicated from tile to tile such that when the tiles are brought into abutting relation with one another across a surface to be covered, a visible seam is formed at the abutting interface between the individual tiles.

As will be appreciated, when a multiplicity of carpet tiles are laid together, a void or seam at the interface between each tile section has the effect of clearly delineating the intersections between the individual tiles which may prevent the perception of a continuous covering. In some settings the perception of continuity in a covering is considered to be of benefit. Accordingly, the substantial elimination of visible seams between carpet tiles presents a useful advancement over the present art.

SUMMARY OF THE INVENTION

In view of the foregoing, it is a general object of the present invention to provide piled fabric sections, such as carpet tiles, the edges of which are cut in a manner so as to substantially eliminate the occurrence of visible seams when the fabric sections are placed in abutting relation across a surface to be covered.

In that respect, it is an object of the present invention to provide an apparatus for use in the cutting of a piled fabric into sections such that the edges of the cut sections may be placed in abutting relation to one another without the occurrence of a substantially visible seam.

It is a related object of the present invention to provide a method of cutting piled fabric sections such that the edges of the cut sections may be placed in abutting relation to one another without the occurrence of a substantially visible seam.

Accordingly, it is a feature of the present invention to provide an apparatus and method of use in the cutting of piled fabric sections such as carpet tiles wherein the apparatus is provided with bending means for bending the pile elements of the fabric toward the fabric base along a line to be cut, and cutting means for cutting through at least a portion of the bent pile elements as well as the fabric base along the line to be cut, thereby leaving the pile elements adjacent to one side of the cut substantially undisturbed.

It is a subsidiary feature of the present invention to provide an apparatus and method of use in the cutting of piled fabric sections wherein the cutting means are themselves moveable and are moved through the pile elements of the fabric so as to bend the pile elements toward the fabric base and preferably toward the center of the resultant tile prior to cutting through the fabric to form a two-sided cut, thereby cutting through a portion of the bent piles adjacent to one side of the cut while leaving the pile elements adjacent to the other side of the cut substantially undisturbed.

It is yet a further feature of the present invention to provide an apparatus and method of use in the cutting of piled fabric sections wherein a plurality of cutting blades are oriented to form a quadrangle so as to cut a substantially square tile.

In accordance with one aspect of the present invention, an apparatus for use in the cutting of piled fabric into sections such as carpet squares is provided. The apparatus comprises a frame, a bending assembly for bending a portion of piling elements away from the normal vertical orientation with respect to the base of the fabric along a line to be cut, a cutting blade for cutting the fabric through a portion of the bent piling elements and fabric base and means for powering the bending and cutting operations.

In accordance with another aspect of the invention, a method of cutting piled fabrics into sections such as carpet tiles is provided. The method comprises the steps of bending the piling elements of the fabric downward toward the fabric base along a line to be cut and thereafter cutting through a portion of the bent piling elements and through the fabric base to form a two-sided cut. Such a cutting method has the effect of shearing the piling elements adjacent to one side of the cut while leaving the piling elements adjacent to the other side of the cut substantially unaltered.

In accordance with yet another aspect of the present invention, a cut fabric section such as a carpet tile is provided. This fabric section is formed by downwardly bending piling elements away from the normal vertical orientation toward the base of the fabric along a line to be cut preferably toward the interior of the resultant tile and thereafter cutting through a portion of the bent elements and through the fabric base. The pile elements adjacent to one side of the cut are partially sheared, while the pile elements adjacent to the other side of the cut remain substantially unaltered. The section of fabric having the partially sheared pile elements is disposed of for recycling while the section having substantially unaltered pile elements is retained for use in abutting orientation with other sections cut in a similar manner.

BRIEF DESCRIPTION OF THE DRAWINGS

The foregoing and other objects, advantages and features of the invention, and the manner in which the same are accomplished, will become more readily apparent upon consideration of the following detailed description of the invention taken in conjunction with the accompanying drawings which illustrate preferred and exemplary embodiments, and wherein:

FIGS. 1–5 show an embodiment of the apparatus of the present invention during sequential stages of the cutting process;

FIGS. 6–10 show an alternative embodiment of the apparatus of the present invention during sequential stages of the cutting process;

FIG. 16 is a cut-away top plan view of a preferred working configuration for the apparatus of the present invention wherein the cutting blades are in an extended position;

FIG. 17 is a view similar to FIG. 16 but showing the cutting blades in a retracted position;

FIG. 18 shows a partially cut-away side view of the working configuration illustrated in FIGS. 16–17 for use in cutting moving fabric.

Figure 4:
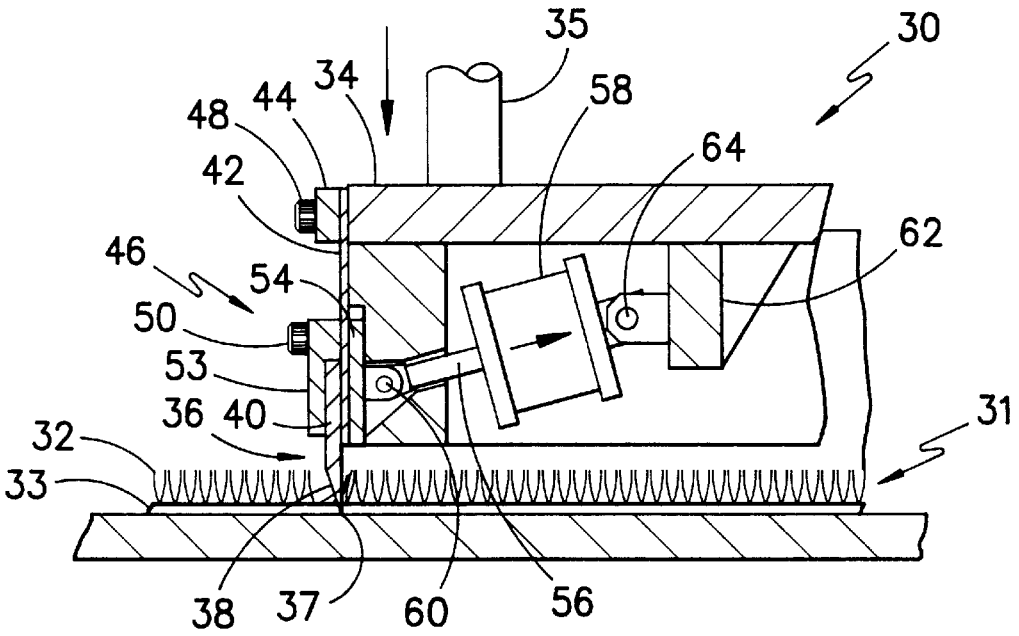

While the invention will be described and disclosed in connection with certain preferred embodiments and procedures, it is in no way intended to limit the invention to those specific embodiments. Rather, it is intended to cover all such alternative embodiments and modifications as fall within the spirit and scope of the invention as defined by the appended claims.

DETAILED DESCRIPTION

Referring now to the drawings wherein like reference numerals indicate like components in the various views, a partially cut-away side view of a potentially preferred embodiment of the basic apparatus 30 of the present invention is shown in FIG. 1. The apparatus 30 is useful in the cutting of piled fabric 31 having a piling portion 32 made up of individual pile elements and a substantially solid base portion 33. The base portion typically comprises a pile bonding matrix and some type of backing as is well known in the art. As illustrated, the basic apparatus 30 includes a frame 34 to which a cutting blade 36 is operatively connected. By cutting blades is meant any means for generating a two-sided cut in the piled fabric 31. It is to be understood that the frame 34 may be of any suitable geometry and may support a plurality of cutting blades 36 as discussed more fully below. The apparatus 30 is preferably moveable between the raised position illustrated in FIG. 1 and the lowered cutting position illustrated in FIGS. 2–4 by means of one or more driving rods 35 powered by appropriate power means such as a hydraulic or pneumatic cylinder (not shown).

In the illustrated and preferred embodiment, the cutting blade 36 includes a cutting portion 37 formed by a bevelled surface 38 and a substantially straight surface 39. The bevelled surface 38 may have an angle of between about 12 degrees and about 35 degrees. An angle of about 20 degrees may be preferred. The cutting blade 36 also preferably includes a body portion 40 which provides support and strength. The cutting blade 36 preferably extends in a lengthwise direction substantially transverse to the side view shown, thereby permitting a two-sided cut of up to eighteen inches or more to be made in the piled fabric 31.

The cutting blade 36 is preferably connected to the frame 34 by means of a connective extension member 42. As illustrated, the connective extension member 42 preferably extends between a frame clamp 44 and a blade support member 46. The connective extension member 42 is preferably maintained in position between the frame clamp 44 and the frame 34 by means of connecting screws 48. As will be appreciated, a number of connecting screws 48 may extend across the length of the frame clamp 44 as may be necessary to support the connective extension member 42 clamped therein. As illustrated, the connective extension member 42 is also preferably secured to the blade support member 46 by means of connecting screws 50.

The blade support member 46 is preferably formed of structural steel and has a substantially inverted L-shaped cross sectional configuration including a first leg 52 and a second leg 53. In the preferred embodiment, the first leg 52 has a width which is substantially equivalent to the width of the body portion 40 of the cutting blade 36 so as to effect a good mating relationship therebetween.

The containment of the cutting blade 36 between the blade support member 46 and the connective extension member 42 is maintained by the tensioning of the connecting screws 50 which preferably extend through both the connective extension member 42 and the blade support member 46. While only a single connecting screw 50 is illustrated, it is to be understood that a number of such connecting screws 50 may be disposed across the length of the blade support member 46. By way of example only, it has been found that for a blade of 12 inches in length and having a width of 0.125 inches, adequate support is provided by 11 connecting screws 50 disposed approximately every inch across the length of the blade support member 46.

In the embodiment illustrated in FIGS. 1–5, the connective extension member 42 is preferably disposed in abutting relation along one face of the body portion 40 of the cutting blade 36. As shown, this configuration gives rise to a substantially inverted U-shaped clamping structure formed by the connective extension member 42 and by the first and second legs 52, 53 of the blade support member 46.

It is to be appreciated that the blade support member 46, the connective extension member 42 and the frame clamp 44 comprise a connective assembly for connecting the cutting blade 36 to the frame 34. It is to be understood that suitable alternative connective assembly embodiments such as alternative clamping devices and the like may likewise be utilized and are considered within the scope of the present invention.

In the illustrated and preferred embodiment, one or more secondary support plates 54 are located adjacent to the connective extension member 42. As will be recognized, while a single secondary support plate 54 is shown in the side views of FIGS. 1–5, a number of such secondary support plates may be disposed at locations along the length of the connective extension member 42. The use of the secondary support plates 54 permits the connective extension member 42 to be formed of a relatively flexible material such as, for example, spring steel without compromising the securement of the cutting blade 36. As discussed in greater detail hereafter, the ability to use spring steel or similar flexible materials for the connective extension member 42 is important to the operation of the apparatus 30.

The secondary support plates 54 are preferably connected to the rods 56 of power cylinders 58 at first pin joinder assemblies 60. The power cylinders 58 are, in turn, preferably supported to frame extension members 62 at second pin joinder assemblies 64. While a single power cylinder 58 is illustrated, it is intended that a plurality of power cylinders 58 may be disposed along the length of the cutting blade 36 as may be required. For example, it has been found that two power cylinders 58 each generating 125 pounds of force are adequate for operation of a 12 inch cutting blade 36 (FIG. 16).

The sequence of steps in the use of the apparatus of the present invention is shown in FIGS. 1–5. As illustrated therein, in the starting position (FIG. 1) the apparatus 30 is in the raised position away from the piled fabric 31 which is to be cut. The rods 56 of the power cylinders 58 are in the extended position thereby placing a bending moment on the connective extension member 42 and forcing the edge portion 37 of the cutting blade 36 away from a perpendicular orientation with respect to the piled fabric 31. The power cylinders 58 and associated cylinder rods 56 thus comprise a first power assembly for moving the edge portion 37 towards and away from the frame 34 such that the cutting blade 36 may be moved in a sweeping manner through the piling portion 32 of the piled fabric 31 as described below. It will, of course, be appreciated that a number of alternative power assemblies as are known to those of skill in the art may likewise be utilized to effect the same result within the scope of the present invention. As will be appreciated, the use of spring steel or other material with similar characteristics of strength and flexibility in the connective extension member 42 permits bending movement without degradation due to embrittlement or plastic deformation.

With the rods 56 in their extended position, the cutting portion 37 of the cutting blade 36 is typically offset from its non-extended position (FIG. 3) by a horizontal distance of between about 0.03 inches and about 0.25 inches. Such an offset distance is applicable to any embodiment which may be utilized. By way of example only, it is believed that for a fabric having a pile height of approximately 0.20 inches, a horizontal blade offset of approximately 0.125 inches may be preferred.

As illustrated in FIG. 2, in the second step of the cutting process using the apparatus 30 of the present invention, the apparatus 30 is moved towards the piled fabric 31 by a second power assembly comprising the driving rods 35 powered by an appropriate power mechanism such as, for example, a hydraulic or pneumatic cylinder (not shown) as are well known to those of skill in the art. This movement of the apparatus 30 towards the piled fabric 31 preferably continues until the cutting portion 37 of the cutting blade 36 is disposed within the piling portion 32 of the piled fabric 31. This movement, however, is terminated prior to the cutting portion 37 of the cutting blade 36 reaching the upper surface of the substantially solid base portion 33.

Once the cutting portion 37 of the cutting blade 36 is disposed within the piling portion 32 of the piled fabric 31, the rods 56 of the power cylinders 58 are retracted until the cutting portion 37 of the cutting blade 36 is preferably substantially perpendicular to the base portion 33 of the piled fabric 31 (FIG. 3). As shown, the retraction of the rods 56 causes the cutting blade 36 to move through the piling portion 32 of the piled fabric 31, thereby tending to bend a portion of the pile elements in the direction of the applied force beneath the cutting portion 37 downwardly toward the base 33 of the piled fabric 31 along a line to be cut. As illustrated, in performing the bending operation, the pile elements are preferably bent toward the interior of the fabric section being cut, although it is to be understood that alternative bending practices as may occur to those of skill in the art may also be utilized.

It can be seen that in the illustrated embodiment the power cylinders 58 acting through cylinder rods 56 and cutting blade 36 comprise an assembly for bending the pile elements in the manner described. It will, of course, be appreciated by those of skill in the art that alternative manual or mechanized bending assemblies which operate either in conjunction with a cutting blade or independently therefrom may likewise be utilized.

Once the cylinder rods 56 are retracted, thereby moving the cutting blade 36 through the piling portion 32 of the pile fabric 31, the apparatus 30 is driven downward by the second power assembly, thereby forcing the cutting portion 37 of the blade member 36 through the substantially solid base portion 33 of the piled fabric 31 in the manner illustrated in FIG. 4. Thus, it is to be appreciated that the first and second power assemblies are preferably operative in conjunction with one another such that the cutting portion 37 of the cutting blade 36 is moved through the piling portion of the piled fabric 31, thereby bending the pile elements in the direction of movement of the cutting portion 37 prior to the cutting portion 37 being driven through the fabric 31 to form a two sided cut therein.

Figure 5:
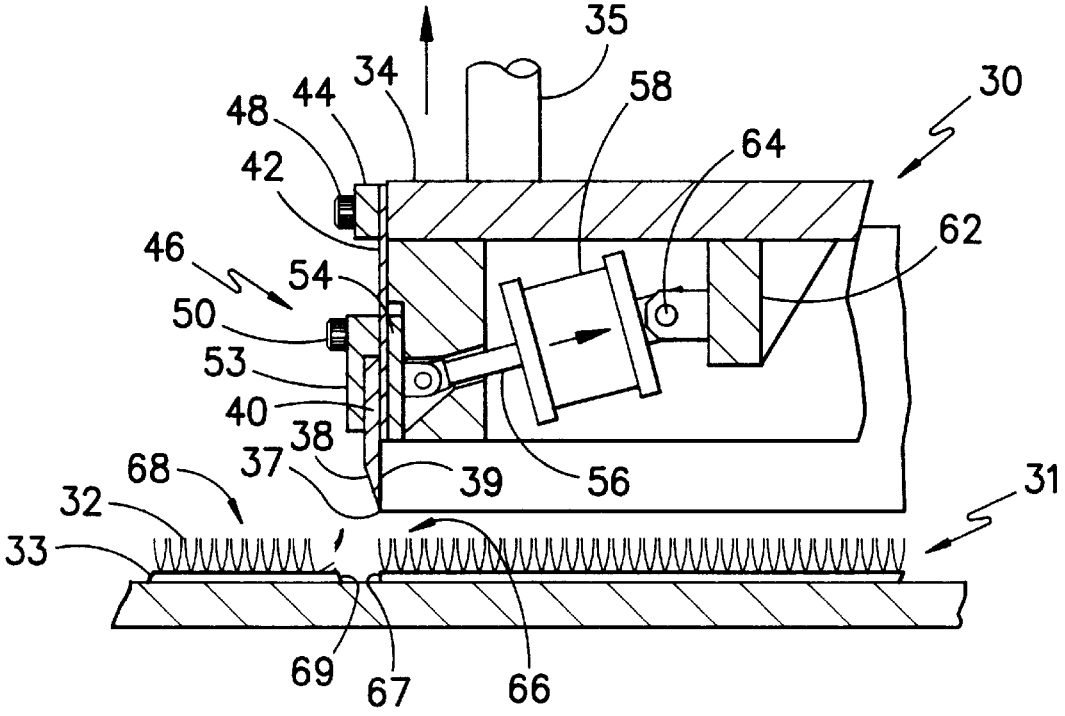

As will be appreciated, this cutting operation has the effect of shearing the individual pile elements bent beneath the cutting blade 36. This shearing of the bent pile elements is shown in FIG. 5, wherein the apparatus 30 has been moved away from the piled fabric 31 leaving a first fabric section 66 having a cut edge 67 and a second fabric section 68 having a cut edge 69. As illustrated, the cut edge 67 of the first fabric section 66 is formed by the substantially straight surface 39 on the cutting blade 36, while the cut edge 69 of the second fabric section 68 is formed by the beveled surface 38. Due to the substantially perpendicular orientation of the substantially straight blade surface 39, with respect to the fabric backing 33 and due to the bending of the pile elements beneath the cutting blade 36, the pile elements adjacent to the non-chamfered straight cut edge 67 of the first fabric section 66 remain substantially unaltered following the cutting operation. By contrast, the pile elements adjacent to the bevelled edge 69 of the second fabric section 68 are partially sheared by the beveled face 38 of the blade 36. Accordingly, the second fabric section 68 is recycled while the first fabric section 66 may be placed in abutting relation with other similarly cut fabric sections (FIG. 20) without the occurrence of substantially visible seams between the individual sections.

A second embodiment of the apparatus of the present invention is shown in FIGS. 6–10. The apparatus 130 of the second embodiment includes a beveled blade 136 attached to a frame 134 by means of a hinged extension member 180. Specifically, the beveled blade 136 is attached to the hinged extension member 180 by connective bolts 182. The hinged extension member 180 is, in turn, connected to the frame 134 at a hinge pin connection 184 so as to allow the partial rotation of the hinged extension member 180 and attached cutting blade 136 thereabout.

In the embodiment illustrated in FIGS. 6–10, the hinged extension member 180 is preferably connected to rods 156 of power cylinders 158 by means of pin connection members 160. The power cylinders 158 are, in turn, preferably connected to a frame extension member 162 by pin connection members 164, thereby providing a support structure for the operation thereof.

As shown, the extension of the cylinder rods 156 forces the hinged extension member 180 and the attached cutting blade 136 away from the frame 134 about the hinge pin connection 184, thereby moving the cutting blade 136 from a position substantially perpendicular to the piled fabric to an orientation at an angle therewith and preferably providing a horizontal displacement of the cutting blade 136 of between about 0.03 inches and about 0.25 inches.

As will be appreciated, the apparatus 130 effects a cutting of the piled fabric 31 according to substantially the same method as described above in relation to FIGS. 1–5 and the embodiment shown therein. Specifically, the frame 134 (with the blade member 136 in the extended position) is lowered into engagement with the piling portion 32 of the piled fabric 31 (FIG. 7). The rods 156 of the power cylinders 158 are thereafter retracted so as to move the cutting portion 137 of the cutting blade 136 through the piling portion 32 of the piled fabric 31 (FIG. 8). The cutting portion 137 of the cutting blade 136 is then driven through the base portion 33 of the piled fabric 31 (FIG. 9) so as to generate a two-sided cut wherein the pile elements adjacent to one side formed with a substantially straight non-chamfered cut are left substantially unaltered (FIG. 10).

Figure 14:
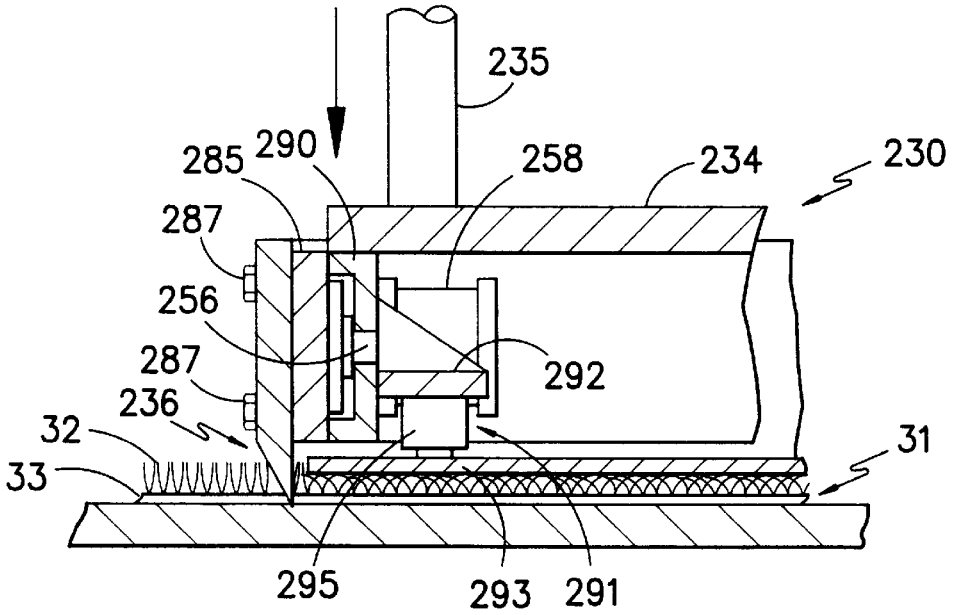
Figure 15:
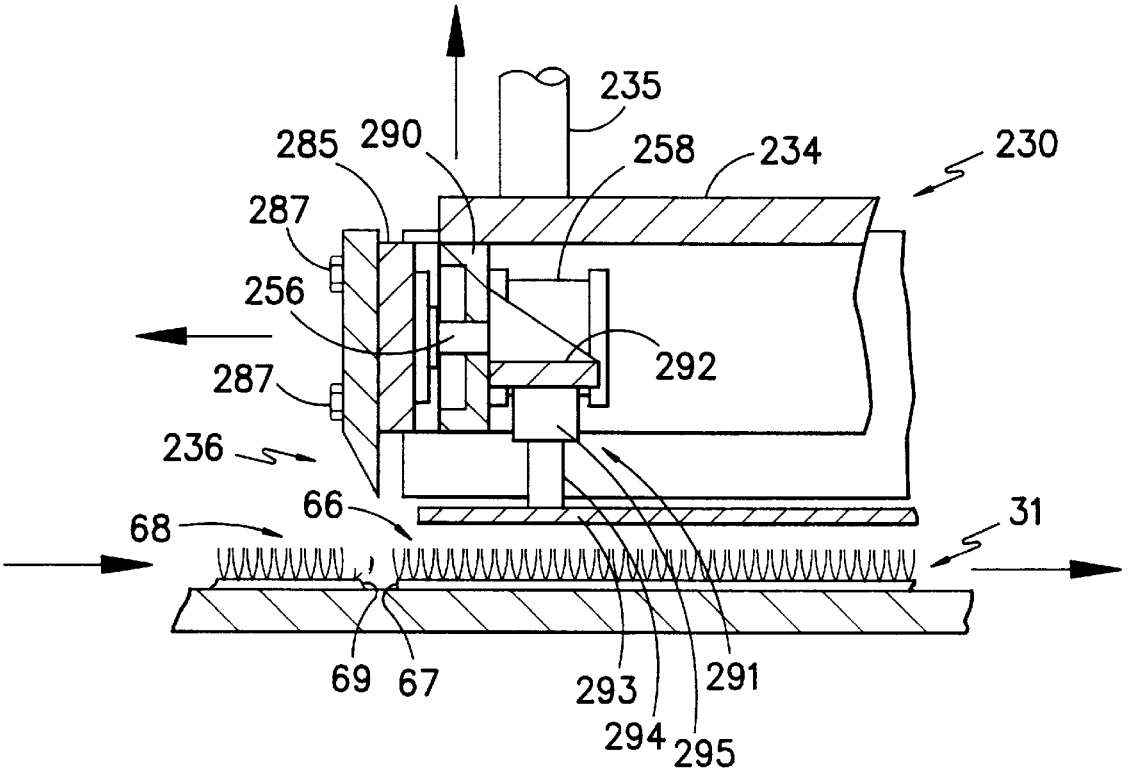

Yet a third embodiment of the present invention is shown in FIGS. 11–15 wherein the apparatus 230 incorporates yet another configuration for moving the cutting blade 236 through the piling portion 32 of the pile fabric 31 to effect a substantially straight cut without altering the pile elements disposed adjacent thereto. It is to be appreciated that the apparatus 230 effects the cutting operation in substantially the same manner as described with respect to other embodiments. That is, the cutting blade 236 is moved into contact with the piling portion 32 of the fabric 31 (FIG. 12), is moved through the piling portion 32 to bend the pile elements along a line to be cut (FIG. 13) and is then driven through the base 33 of the piled fabric (FIG. 14) to form a two-sided cut (FIG. 15).

As illustrated, the apparatus 230 includes a frame portion 234 and a bevelled cutting blade 236 connected to a support plate 285 by means of connective bolts 287. The support plate is, in turn, operatively connected to one or more cylinder rods 256 actuated by power cylinders 258. The cutting blade 236, support plate 285, piston rods 256 and power cylinders 258 are preferably aligned so as to impart to the cutting blade a substantially linear motion towards and away from the frame 234 as the piston rods 256 are extended and retracted. This linear movement preferably corresponds to a horizontal displacement of between about 0.03 inches and about 0.25 inches. The power cylinders 258 are preferably supported against a leg portion 290 of the frame 234 adjacent to the support plate 285. As illustrated, the leg portion 290 is preferably provided with openings through which the piston rods 256 may act.

The apparatus 30, 130, 230 also preferably includes a fabric securement assembly 291 such as illustrated in FIGS. 11–15. This fabric securement assembly is preferably attached to the frame 234 by means of one or more frame extensions 292 and includes a plate 293 connected to one or more biased rods 294 housed in cylinders 295. As illustrated when the frame 234 is lowered by means of driving rods 235, the plate 293 contacts and compresses the piling portion 32 of the piled fabric 31. During this process, the bias of the rod 294 is overcome, thereby driving the rods 294 into the cylinders 295 while at the same time applying an opposing force equal to the overcome bias to the piled fabric 31.

While FIGS. 11–15 illustrate a single rod 294 and cylinder 295, a number of such rods and cylinders may be utilized. Specifically, if a preferred rectangular organization of a plurality of blades is utilized as illustrated in FIGS. 16–18, the fabric securement assembly 291 may comprise a rod 294 and corresponding compression cylinder 295 located at each corner of the cutting unit (FIG. 18).

It is to be understood that the use of the fabric securement assembly 291 is in no way limited to any single embodiment of the apparatus of the present invention. Rather it is contemplated that the fabric securement assembly 291 is preferably used with any embodiment of the apparatus 30, 130, 230 of the present invention. Regardless of the embodiment, the distance between the edge of the cutting blade 36, 136, 236 and the edge of the plate 293 should be between about 0.002 inches and about 0.05 inches and preferably between about 0.01 inches and about 0.02 inches during the actual cutting operation (FIG. 14).

As alluded to previously, while each of the embodiments of the present invention have been illustrated and described as incorporating a single cutting blade, it is to be understood that the basic unit apparatus of any embodiment may be combined in a configuration suitable for cutting a fabric section of a desired geometry out of a larger piece of fabric. A top plan view of one working configuration incorporating the embodiment of the apparatus 230 shown in FIGS. 11–15 is illustrated in FIGS. 16–17. As illustrated, four substantially identical cutting units 230*a*, 230*b*, 230*c* and 230*d* are arranged in a rectangular configuration mounted to a square frame 234 so as to enable four substantially identical cuts to be made in the piled fabric 31 thereby forming a substantially square tile section. Each of the substantially identical cutting units 230*a*–230*d* includes two substantially identical power cylinders 258 as described above. The two power cylinders 258 on each of the cutting units operate in conjunction with one another to move the individual cutting blades 236 towards and away from the frame 234 by means of extension and retraction of their individual rods 256.

Figure 11:
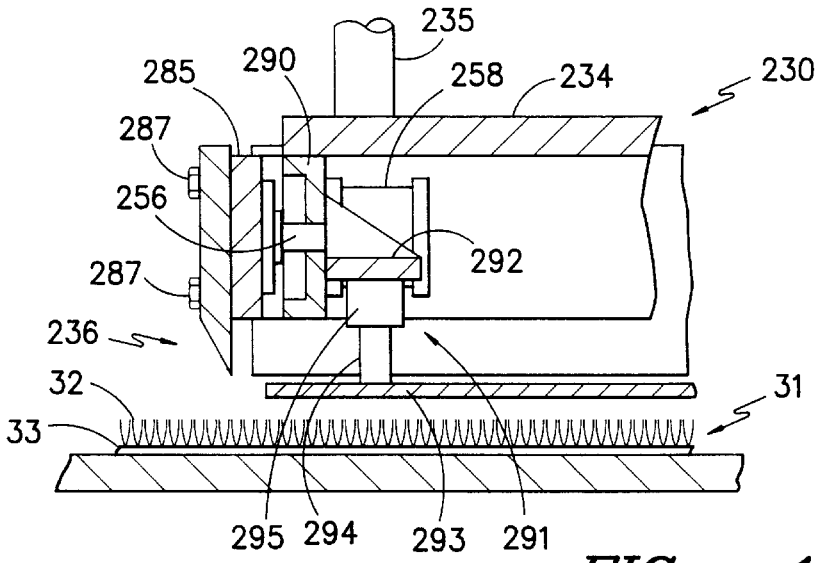
FIGS. 11–15 show an alternative embodiment of the apparatus of the present invention during sequential steps of the cutting process further illustrating a fabric securement device which may likewise be utilized in the embodiments of FIGS. 1–10.
Figure 12:
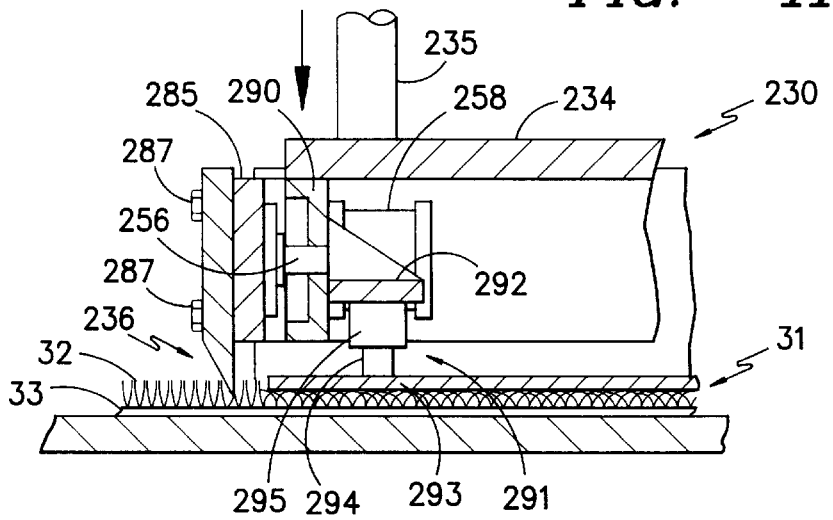
Figure 13:
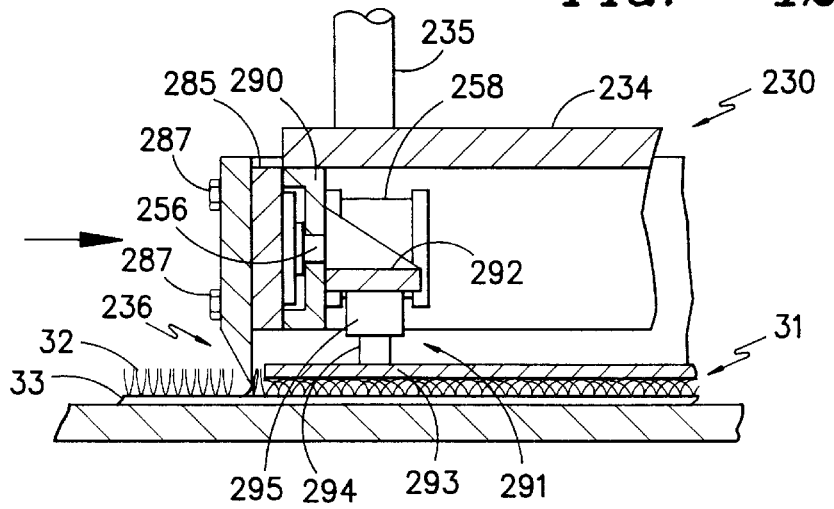

With respect to the movement of the cutting blades 236, the blades illustrated in FIG. 16 are in a position corresponding approximately to that shown in the side view of FIG. 11 wherein the rods 256 are in their extended position. When the rods 256 are retracted, the cutting blades 236 are moved towards the frame 234 as shown in FIG. 17. In this retracted state the cutting blades 236 are in a position corresponding approximately to that shown in FIG. 13. As illustrated, the support plates 285 and connected cutting blades travel on guide rods 270 between the extended position shown in FIG. 16 and the retracted position shown in FIG. 17. In the rectangular orientation illustrated in FIGS. 16–17, acceptor ports 272 are oriented at each corner of the frame 234 to accept driving rods 235 which are used to move the frame 234 and cutting blades 236 downward as described above. As indicated previously, the driving rods 235 may be powered by any appropriate power means such as, for example, a hydraulic or pneumatic master cylinder 297 applying equal force to each of the driving rods across an intermediate transfer plate 299 (FIG. 18).

Preferably, the power cylinders 258 which actuate each of the individual cutting units 230*a*–230*d* are operable in a manner such that at least two, and preferably four, of the cutting units 230*a*–230*d* may be operated substantially simultaneously. It will of course be recognized that while the configuration illustrated in FIGS. 16–17 is shown as incorporating the particular embodiment of the invention illustrated in FIGS. 11–15, all other potential embodiments of the invention may be configured in a similar manner so as to effect the cutting of given geometries of piled fabric such as carpet squares. Thus, it is intended that a plurality of cutting units incorporating any illustrated or potential embodiment may be combined in a like described manner.

As previously indicated, regardless of the embodiment used, the cutting units may be moved towards and away from the piled fabric 31 by power assemblies as are well known. By way of example only and not limitation, one such power assembly is illustrated in FIG. 18 wherein the master cylinder 297 is used to drive the cutting blades 236 into contact with, and then through, the piled fabric 31. It will, of course, be appreciated that a number of alternative configurations may likewise be utilized as may be contemplated by those of skill in the art.

Figure 19:
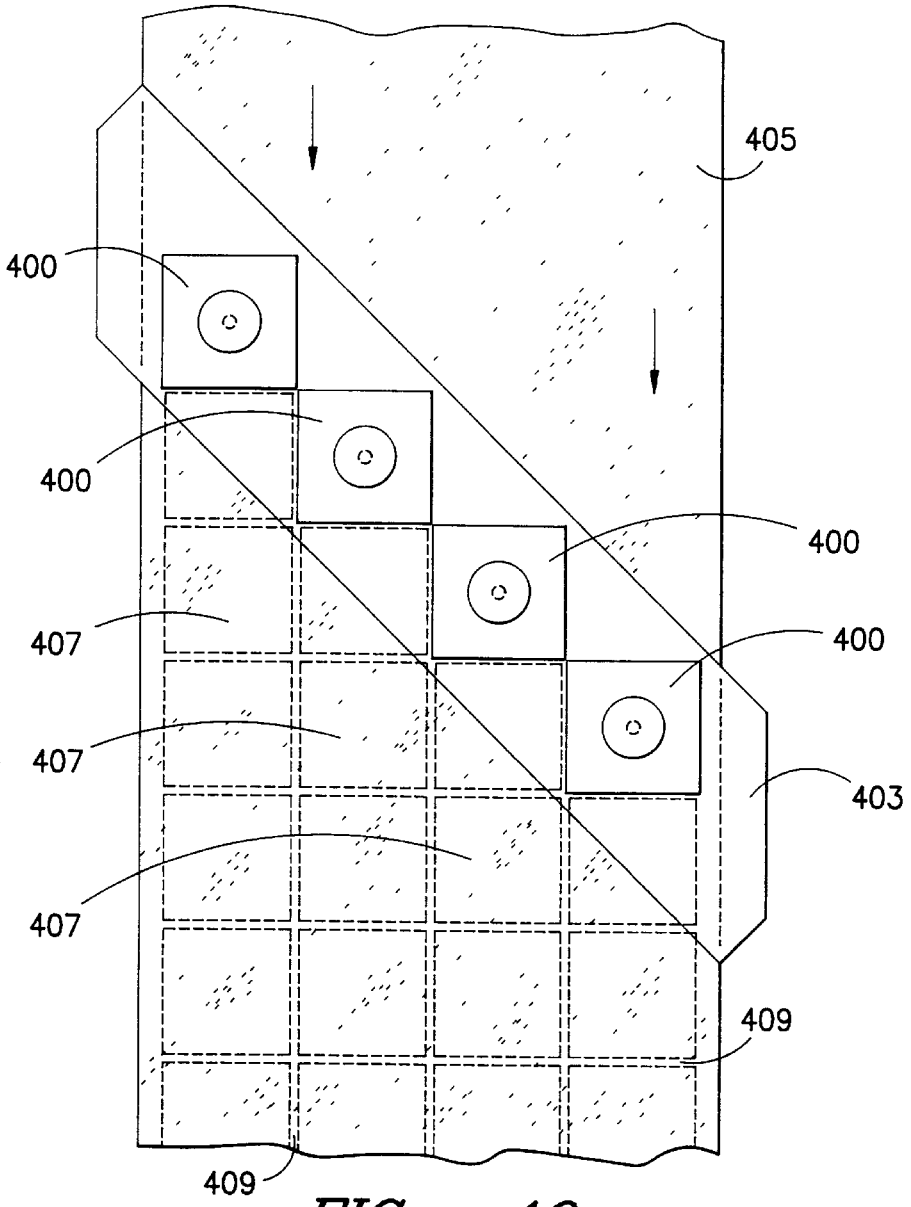
FIG. 19 shows a potential operating organization in which the apparatus of the present invention is used for cutting a plurality of carpet tiles from a broad loom of fabric.

While it is intended that any embodiment of the basic apparatus 30, 130, 230 of the present invention may be utilized in a number of organizational schemes to effect large scale fabric cutting operations, FIG. 19 illustrates one possible organization for the use of the working configuration illustrated in FIGS. 16–18. As shown, each rectangular configuration 400 made up of the basic cutting apparatus 30, 130, 230 may be arranged in a relative diagonal orientation along a suitable support structure 403 (FIG. 18). The support structure 403 provides a base from which the cutting blades may be moved toward and away from a moving broad loom of fabric 405 by appropriate power means in the manner described above. Thus, when the cutting apparatus 30, 130, 230 is lowered into contact with the broad loom 405, fabric sections such as carpet tiles 407 may be cut out as illustrated.

It is to be understood that in the cutting operation, the carpet tiles 407 correspond generally to the first fabric section 66 described above in relation to a single cut and accordingly have substantially straight edges with substantially unaltered pile elements adjacent thereto. Likewise, the intermediate strip sections 409 correspond generally to the second fabric section 68 described previously in relation to a single cut and will exhibit bevelled edges with partially sheared pile elements at the outer perimeter. By using the illustrated orientation it can be seen that only the relatively thin intermediate strip sections 409 are subjected to a shearing of the pile elements, while the majority of the available fabric is cut into useable tiles 407 having straight cut edges which may be placed in abutting relation with one another across a surface to be covered without the occurrence of substantially visible seams therebetween.

Figure 20:
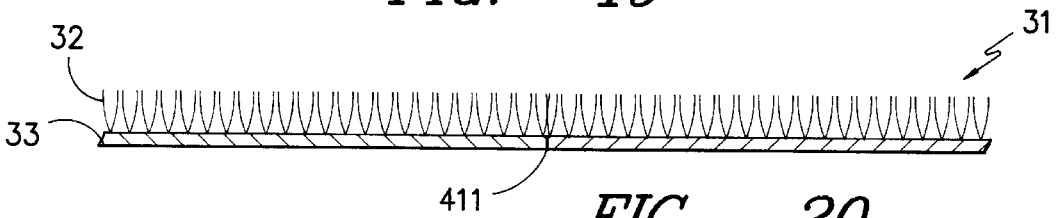
FIG. 20 shows the interface formed between portions of piled fabric cut by the method and apparatus of the present invention.
Figure 21:
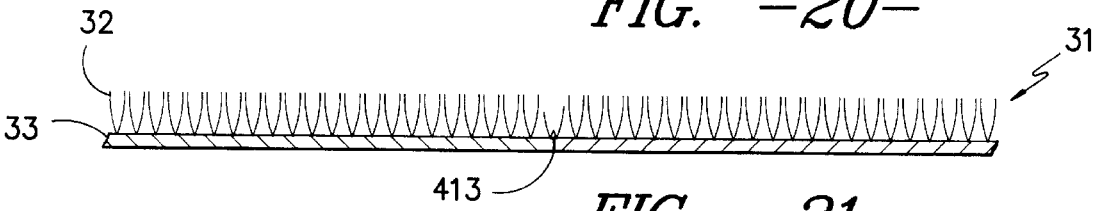
FIG. -21- PRIOR ART
FIG. 21 shows a typical interface between portions of piled fabric cut by prior art processes.

The cut fabric produced by the apparatus and method of the present invention may be appreciated through comparison of FIGS. 20 and 21. In FIG. 20, two portions of piled fabric cut by the apparatus and method of the present invention are shown in abutting relationship along an interface 411. As shown, this interfacial relationship gives rise to no substantial irregularity in the profile of the piled fabric 31, since the piling portion 32 adjacent to the interface 411 has undergone no substantial shearing, thereby preventing the appearance of a substantially visible void. By "substantially visible void" is meant a void which is readily apparent to the average human eye without external assistance or concentrated examination. This may be contrasted to the visible discontinuity at the interface 413 between portions of piled fabric cut according to present methods (FIG. 21) which is generally discernable by casual observation.

While specific embodiments of the invention have been shown and described, it will be understood that the invention is not limited thereto, since modifications may be made and other embodiments will occur to those skilled in the art to which this invention pertains. Therefore, it is contemplated by the appended claims to cover any such modifications and other embodiments as incorporate the features of this invention within the true spirit and scope of the following claims:

What is claimed is:

1. An apparatus for use in the cutting of a piled fabric having a piling portion including pile elements and a base portion, the apparatus comprising: a vertically displaceable support frame; a cutting blade, said cutting blade including a cutting portion and a body portion wherein said cutting portion is formed by a bevelled surface and a substantially straight surface; a connective assembly, comprising a hinged member connected to said cutting blade and said support frame, connecting said cutting blade to said support frame such that said bevelled surface of said cutting blade faces outwardly from said support frame and said substantially straight surface of said cutting blade faces inwardly towards said support frame; a first power assembly operatively connected to said cutting blade for moving said cutting portion of said cutting blade towards and away from said support frame along a substantially horizontal path across said base portion of said piled fabric such that said cutting portion of said cutting blade is moveable through the piling portion of said piled fabric substantially in the direction faced by said substantially straight surface; and a second power assembly operatively connected to said support frame for vertically moving said support frame such that said cutting portion of said cutting blade is driven vertically through the base portion of said piled fabric, said first power assembly and said second power assembly being operative such that said cutting blade may be moved through the piling portion of said piled fabric, thereby bending a portion of said pile elements beneath said cutting blade prior to said cutting portion of said cutting blade being driven through said base portion of said piled fabric to form a two-sided cut therein.

2. An apparatus for use in the cutting of carpet fabric having a piling portion including a multiplicity of pile elements and a base portion, the apparatus comprising: a vertically displaceable support frame; four cutting blades oriented to form a quadrangle, each of said cutting blades having a cutting portion and a body portion, wherein said cutting portions of said cutting blades are each formed by a bevelled surface facing outwardly from said support frame and a substantially straight surface facing inwardly towards said support frame; means for connecting said cutting blades to said support frame such that said cutting portion of said cutting blades is moveable towards and away from said support frame; cylinder means operatively connected to said cutting blades for moving said cutting portions of said cutting blades along a path including a substantially horizontal component in the direction faced by said substantially straight surface; and power means for vertically moving said support frame such that said cutting portions of said cutting blades are driven vertically through said base portion of said carpet fabric, said power means and said cylinder means being operative such that said cutting portions of said cutting blades are moveable through the piling portion of said carpet fabric prior to said cutting portions of said cutting blades being driven vertically through the backing portion of said carpet fabric.

* * * * *